US005726633A

United States Patent [19]

Wiemeyer

[11] Patent Number: 5,726,633

[45] Date of Patent: Mar. 10, 1998

[54] APPARATUS AND METHOD FOR DISCRIMINATION OF FIRE TYPES

[75] Inventor: James F. Wiemeyer, Homer Township, Ill.

[73] Assignee: Pittway Corporation, Chicago, Ill.

[21] Appl. No.: 536,805

[22] Filed: Sep. 29, 1995

[51] Int. Cl.[6] ..... G08B 17/00; G08B 17/10

[52] U.S. Cl. ..... 340/587; 340/522; 340/628; 340/629; 340/630

[58] Field of Search ..... 340/587, 522, 340/628, 629, 630

[56] References Cited

U.S. PATENT DOCUMENTS

| | | | |
|---|---|---|---|
| 4,507,652 | 3/1985 | Vogt et al. | 340/501 |
| 4,644,331 | 2/1987 | Matsushita | 340/587 |
| 4,644,478 | 2/1987 | Stephens et al. | 364/550 |
| 4,803,469 | 2/1989 | Matsushita | 340/577 |
| 4,871,999 | 10/1989 | Ishii et al. | 340/587 |
| 4,884,222 | 11/1989 | Nagashima et al. | 364/5 |
| 4,916,432 | 4/1990 | Tice et al. | 340/518 |
| 4,926,364 | 5/1990 | Brotherton | 364/581 |
| 4,975,684 | 12/1990 | Guttinger et al. | 340/587 |
| 5,267,180 | 11/1993 | Okayama | 364/571.03 |

FOREIGN PATENT DOCUMENTS

| | | |
|---|---|---|
| 0 036 276 | 9/1981 | European Pat. Off. . |
| 2 190 777A | 11/1987 | United Kingdom . |

OTHER PUBLICATIONS

Omron Electronics, Inc., "Fuzzy Logic A 21st Century Technology", dated Nov. 1991.

*Primary Examiner*—Glen Swann

*Attorney, Agent, or Firm*—Dressler, Goldsmith, Milnamow & Katz, Ltd.

[57] ABSTRACT

A multiple sensor smoke detector includes at least an ionization and a photoelectric sensor. Outputs from the sensors are fed to circuitry for generating continuously variable coefficients. One coefficient corresponds to each sensor output. Respective coefficients and sensor outputs are multiplied in multiplier circuitry to produce processed outputs. The processed outputs are combined in a summing circuit to produce at least one output value indicative of a level of detected smoke. The coefficient generating circuitry, the multiplier circuitry and the combining circuitry could be implemented in a programmed microprocessor. The coefficient generating circuitry could be implemented using prestored membership functions indicative of various types of fires.

29 Claims, 10 Drawing Sheets

APPARATUS AND METHOD FOR DISCRIMINATION OF FIRE TYPES

FIELD OF THE INVENTION

The invention pertains to fire detection systems. More particularly, the invention pertains to such systems which take into account the characteristics of different types of fires in determining the presence of an alarm condition.

BACKGROUND

Various types of fire detection systems are known. One such is disclosed in Tice et al. U.S. Pat. No. 4,916,432 entitled Smoke and Fire Detection System Communication assigned to the Assignee of the present application. The disclosure of the Tice et al. patent is incorporated herein by reference.

It has been recognized that it can be desirable at times to be able to detect the presence of different types of fires depending on the characteristics of emitted smoke. For example, it is known that flaming fires exhibit quite different smoke characteristics then do smoldering fires. Flaming fires tend to exhibit smaller smoke particular sizes than do smoldering fires.

It has also been recognized that different types of smoke sensors respond differently depending on the fire type. For example, photoelectric detectors are known to respond more rapidly to smoldering fires than are ionization-type detectors. Similarly, ionization-type detectors are known to respond more rapidly to flaming type fires than do photoelectric detectors.

Thus, there continues to be need for smoke sensors which are appropriately responsive to various types of fires. In this regard, it is known to combine an ionization type sensor with a photoelectric type sensor so as to obtain the benefits of both types of sensors in a single detector.

It would be desirable to be able to process the outputs from such dual sensor detectors taking into account the type of fire being sensed.

In addition to boolean or binary signal processing techniques an expanded range of variables can be taken into account using so-called fuzzy logic techniques. Fuzzy logic and associated design techniques are extensively discussed in general in *Fuzzy Logic and Control,* pub. by Prentice Hall, 1993.

Fuzzy logic production rules and membership functions can be used to provide a different form of signal processing than provided with boolean logic. Fuzzy logic processing techniques can be used in combination with a plurality of input variables.

A plurality of control output values can be generated from the processed input variables. The control output variables can then be processed using traditional boolean logic.

Preferably, the characteristics of fuzzy logic systems could be incorporated into detectors for signal processing of outputs of fire or smoke sensors. Preferably such processing could be incorporated into detectors so as to provide improved performance without significant expense.

SUMMARY OF THE INVENTION

A variable sensitivity detector includes at least first and second different ambient condition sensors. The sensors generate respective first and second outputs indicative of respective sensed ambient conditions.

The sensors, in one aspect of the invention, correspond to ionization and photoelectric sensors. Alternately, the sensors could includes gas sensors and temperature sensors, as well as optical extinction and scattering sensors, or multiple wavelength flame detectors.

Electronic circuitry is provided for processing each of the outputs and for generating in response thereto first and second continuously variable weighting coefficients associated with respective of the outputs. In one aspect of the invention the respective coefficients are multiplied by the respective outputs thereby forming respective first and second weighted outputs.

The weighted outputs, in yet another aspect of the invention can, but need not, be summed forming a final output value. The final output value can be processed further. Processing can be local or remote at a control panel for comparison to one or more threshold for determining whether or not an alarm condition is present. Alternately, the weighted outputs could be compared to one or more pre-established thresholds.

In yet another aspect of the invention, the coefficients can be determined as a result of prestored production rules and membership functions which generate continuously variable coefficient output values. The production rules and membership functions can be stored in a memory unit of a programmed microprocessor. The microprocessor can in turn generate first and second coefficient values in response to sensed ambient condition inputs.

In yet another aspect of the invention, a detector can generate suitable coefficients and arithmetically process the consitutuent sensor data to yield an overall composite sensor output. When compared to a detection threshold, the composite sensor output renders a sensitivity profile subjectively tailored as a function of smoke type.

Designers and users can factory program the detector to address the expected ranges of stimuli, risks, and even agency approval requirements. Similar scenarios apply to gas sensors, temperature sensors and the like.

Other features and advantages of the present invention will become readily apparent from the following detailed description, the accompanying drawings, and the appended claims.

DETAILED DESCRIPTION

Figure 1:
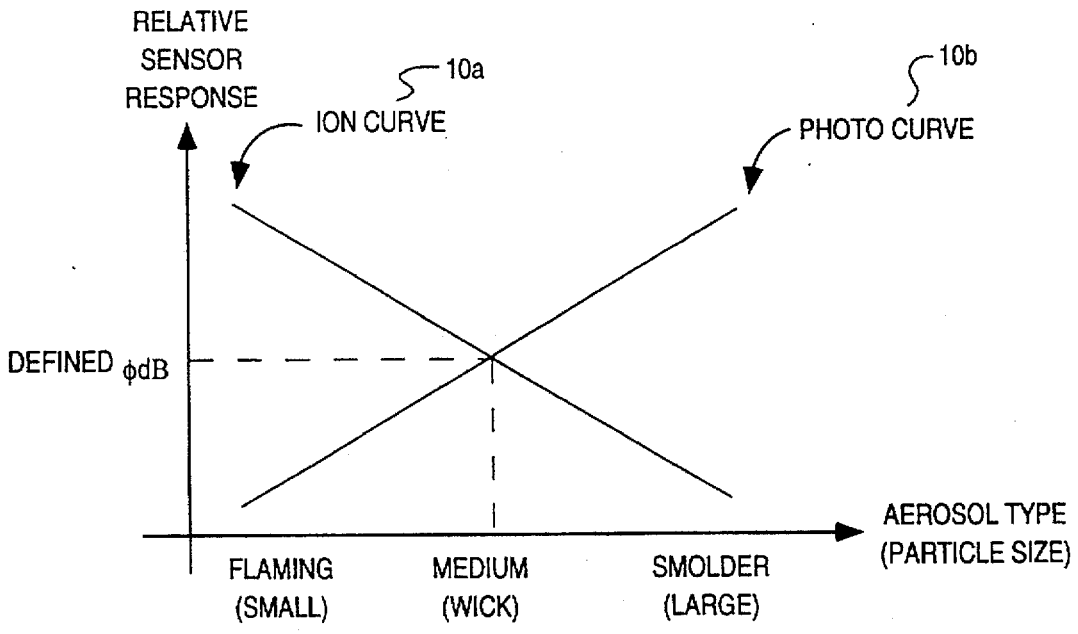
FIG. 1 is a graph illustrating response characteristics of ionization type sensors and photoelectric type sensors as a function of aerosol type or particle size.

While the present invention is a susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

In fire detection systems, deployment of a plurality of fire sensor types typically provides a system response over a wide range of fire scenarios. For example, within the set of thermal, ion, and optical fire detectors:heat detectors best sense clean burning fires, ionization detectors best sense blazing smoking fires, and optical detectors best sense smoldering fires. Underlying the use of different types of sensors rests differing response profiles of the various sensor types to different combustion effluent.

The description of an initial embodiment centers upon a combination optical and ionization detector. FIG. 1 depicts the relative response of an ionization-type sensor, curve 10*a*, and an optical scattering type sensor, curve 10*b*, in logarithmic form, normalized to equal responses for smoldering cotton wick. Comparison of the ordinate values, of a given pair of ($Y_{ion}$, $Y_{photo}$) locates the associated abscissa value, i.e., aerosol type.

Figure 2:
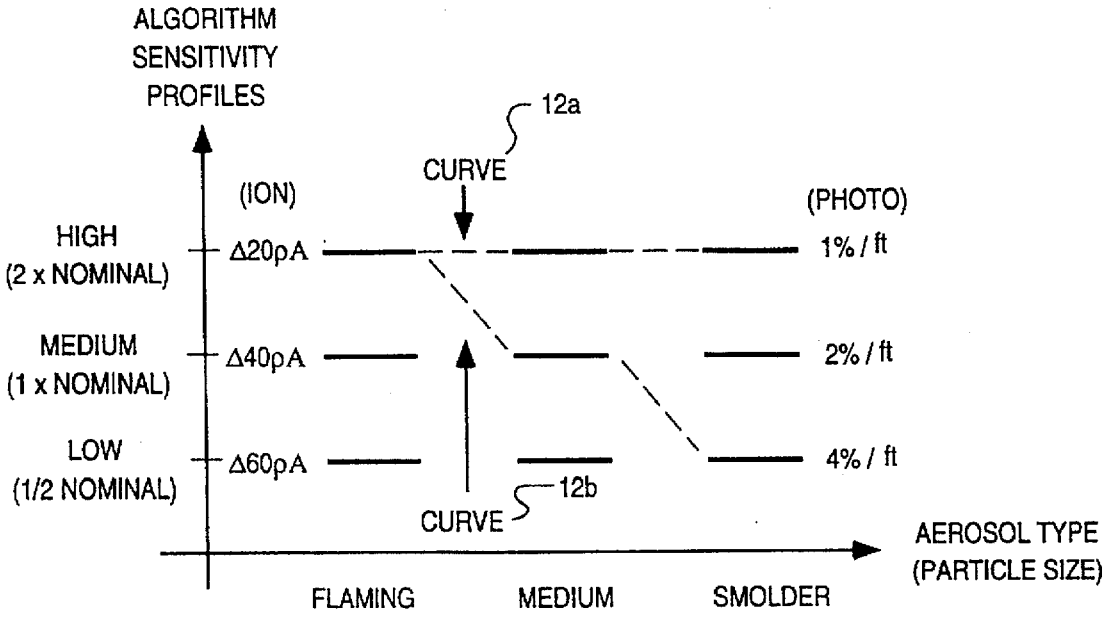
FIG. 2 is a graph illustrating first and second examples of varying sensitivity as a function of aerosol type or particle size.

FIG. 2 is a graph with aerosol type, or particle size, plotted on the x-axis and with sensitivity on the y-axis. Three possible sensitivities appear for each fire type, and three possible fire types subdivide the x-axis.

The present invention enables the choice of sensitivity as a function of fire type. With the indicated subdivisions, $3^3$=27 possible sensitivity profiles avail themselves to the user. Curve 12*a* and curve 12*b* represent 2 of the possible profiles.

Figure 3:
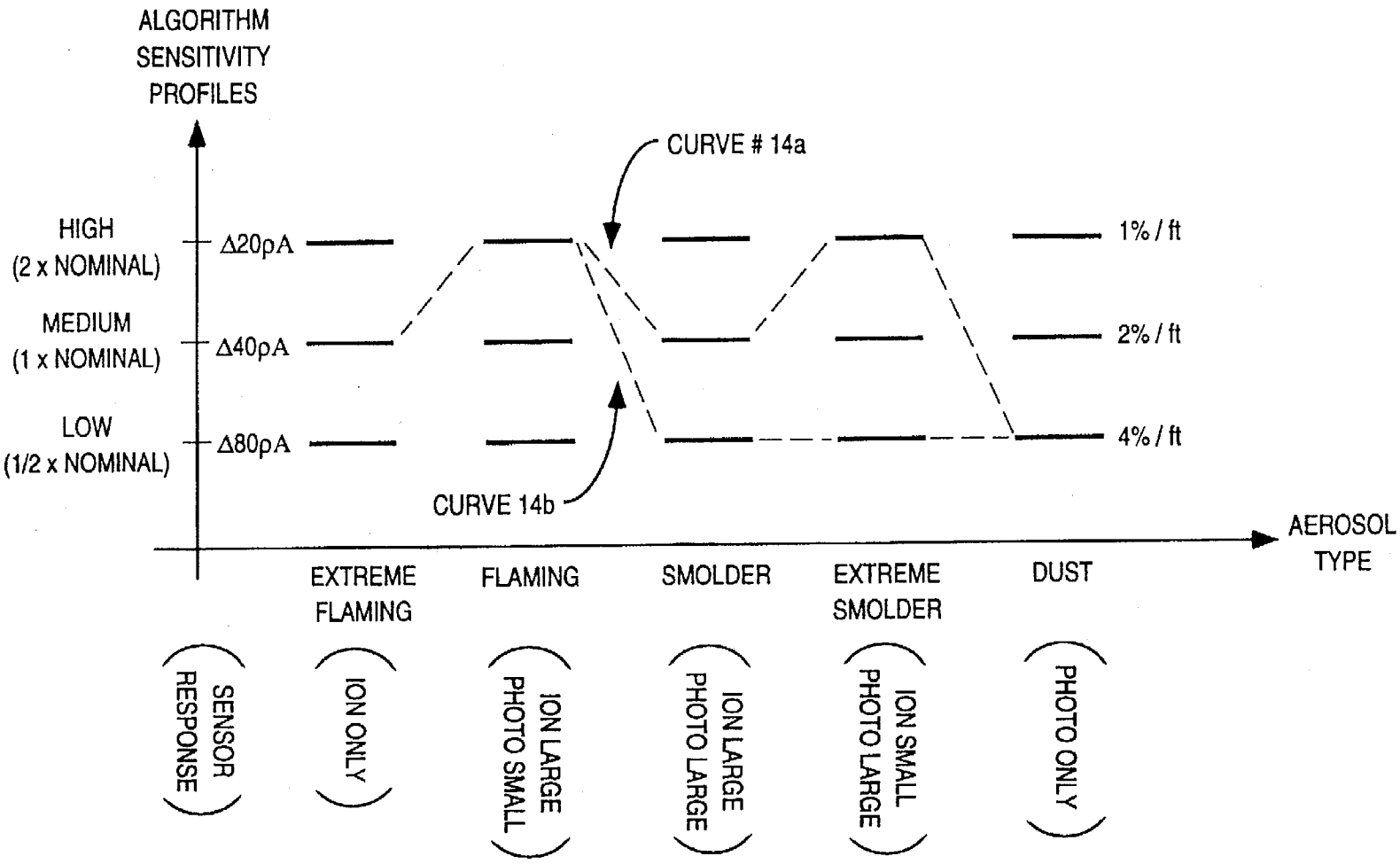
FIG. 3 is a graph illustrating third and forth examples of varying sensitivity as a function of aerosol type or particle size.

FIG. 3 is a graph with three sensitivity levels and 5 possible aerosol types. The configuration yields $3^5$=243 possible sensitivity profiles. Curve 14*a* and curve 14*b* represent just 2 of the 243 possible profiles. Note that generally $y^x$ possible profiles avail themselves to the user, where y represents the number of sensitivity levels, and where x represents the number of aerosol classifications.

Figure 4:
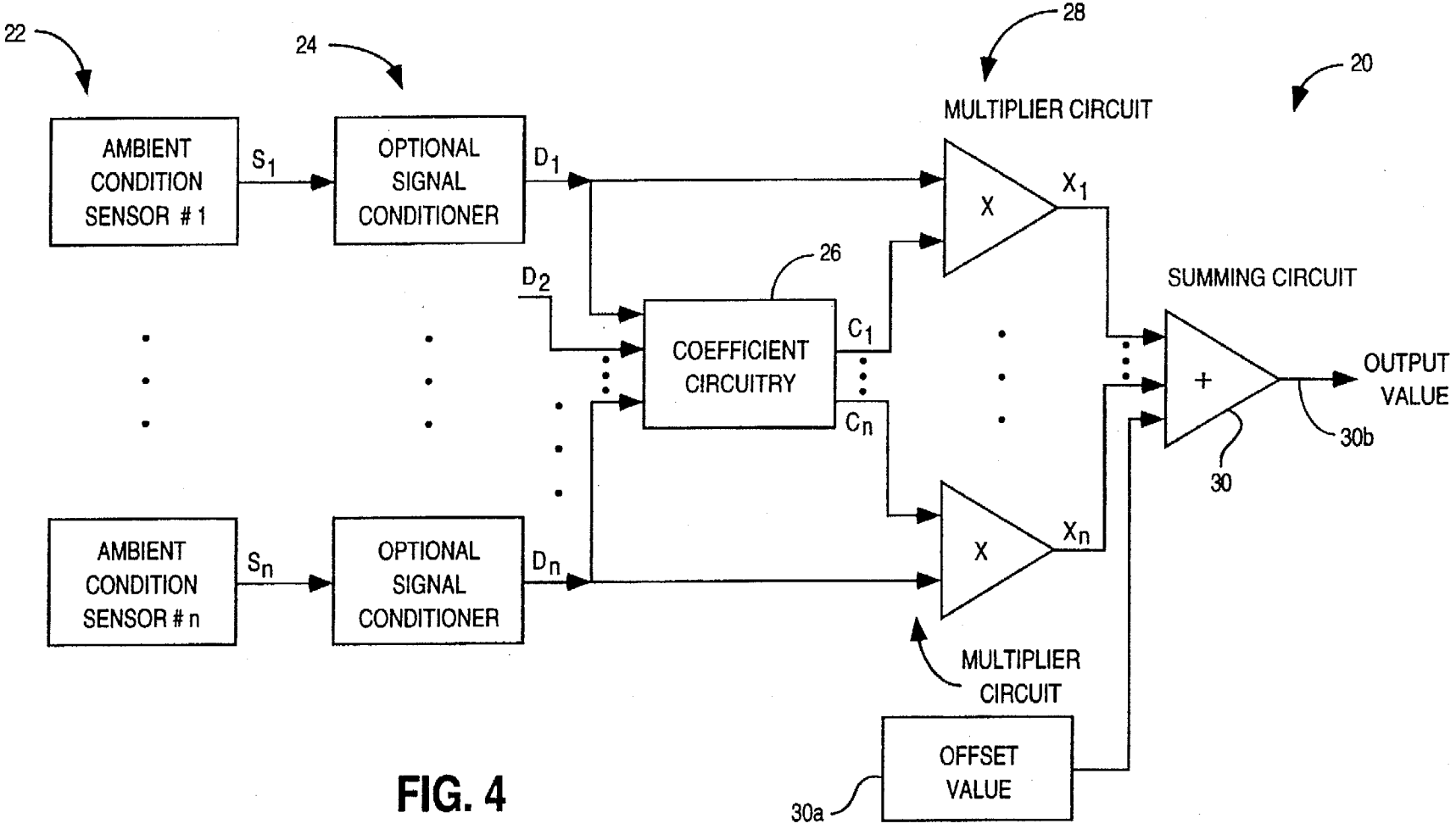
FIG. 4 is a block diagram of a multiple sensor detector in accordance with the present invention.

FIG. 4 is a block diagram of a system or detector 20 in accordance with the present invention. The detector 20 implements a predetermined one of the sensitivity profiles.

A plurality 22 of ambient condition sensors such as ionization smoke sensors and/or optical smoke sensors each produce an output signal $S_1$ . . . Sn indicative of a sensed ambient condition. Each of the sensor output signals $S_1$ . . . Sn can undergo optional signal conditioning in respective members of a plurality 24 of conditioning circuits.

The signal conditioning could consist of bandpass filtering from 4 μHZ to 10 mHZ to equalize the speed of each transducer, and to eliminate offsets. The signal conditioning could also normalize each sensor output, such that each conditioned output yields a value of 1.0 (or any equal value) when stimulated by a smoldering wick smoke (or any chosen aerosol) concentration of optical density 1%/ft. The actual numerical values for normalization and type of signal processing are determined through empirical test dam, and through overall design objectives.

A plurality of conditioned sensor outputs $D_1$ . . . Dn can be further processed. The detector 20 includes circuitry 26 for generating variable weighting coefficients C1 . . . Cn as a function of conditioned outputs D1 . . . Dn from respective members of the plurality of sensors 22. The weighting coefficients C1 . . . Cn are each combined in a respective member of a plurality of multiplier circuits 28 with a respective one of the conditioned sensor values D1 . . . Dn to form a plurality of weighted outputs X1 . . . Xn.

The weighted outputs X1 . . . Xn are summed in a summing circuit 30. An optional offset value 30*a* can also be incorporated. The output from the summing circuit 30, on a line 30*b* reflects a pre-selected sensitivity curve, such as 14*a* or 14*b*, as a function of fire or sensor type. That output can in turn be compared at the detector 20 to one or more reference values which could be implemented at the detector 20 or could be incorporated into a remote, alarm control unit or panel. In the latter implementation, the detector 20 could be a member of a plurality of detectors usable with a communication system of the type disclosed in the Tice et al '432 patent.

Figure 5:
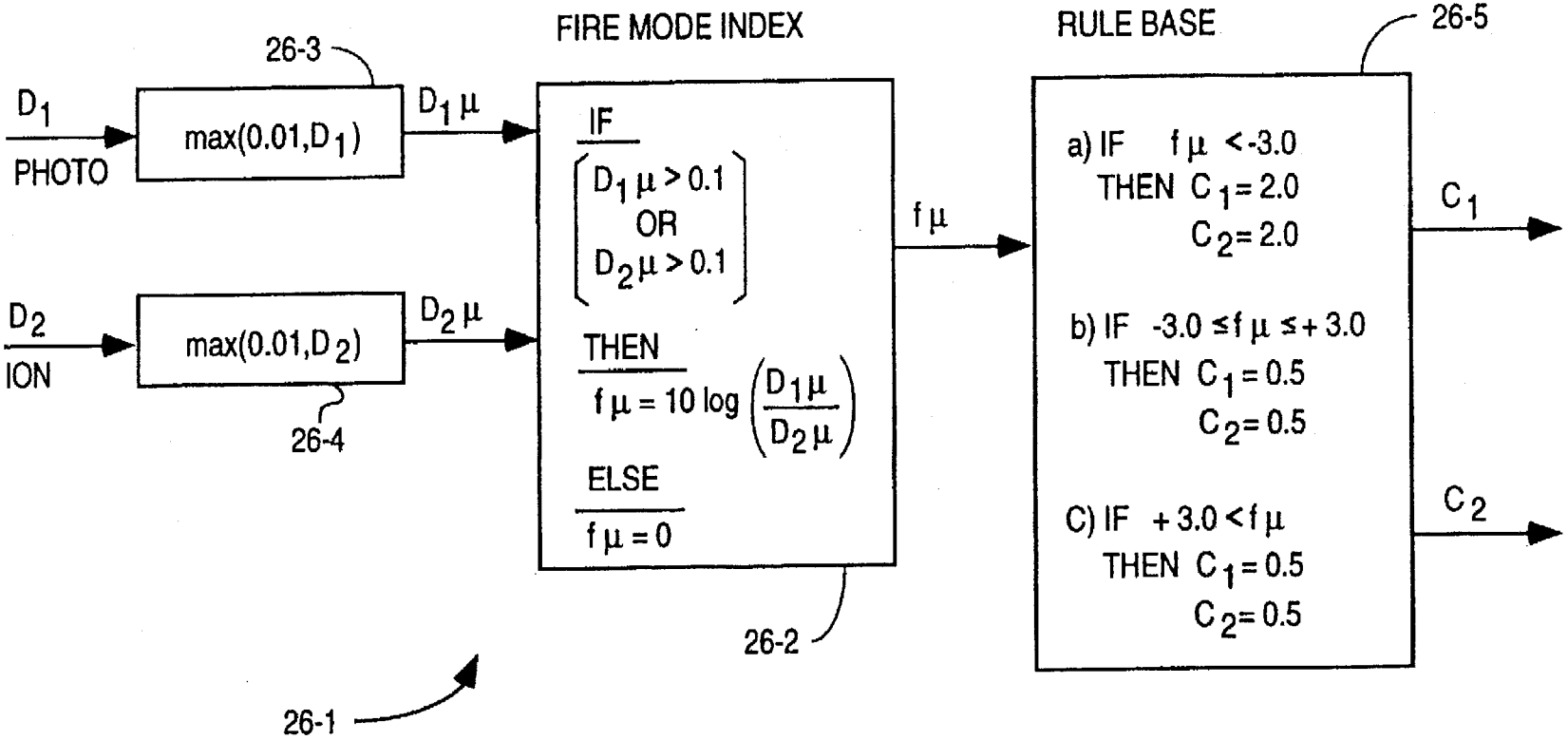
FIG. 5 is block diagram of one form of coefficient circuitry usable with the present invention.

FIG. 5 is a more detailed diagram of exemplary coefficient generating circuitry 26-1 where inputs are present from only two sensors. In this instance only a photoelectric-type signal D1 and an ion-type, signal D2 are provided as in a two-sensor detector.

Preferably, signal comparison should indicate the relative magnitude of signals in a linear fashion. In other words, sensor ratios of 1/2 and 2 should give equal and opposite results. It will be understood that while FIG. 5 illustrates a two sensor coefficient circuit, as described subsequently, additional sensor inputs can be included and would not depart from the spirit and scope of the present invention.

With respect to FIG. 5, first define the preferred function implemented by dement 26-2 as a "fire mode index", fM, similar to decibels (dB):

fM=10 log ($D_1/D_2$) where $D_1$=a filtered and normalized output signal from a photo sensor where $D_2$=a filtered and normalized output signal from an ion sensor If $D_1/D_2$=1/2, then fM=−3.0; but if ($D_1/D_2$)=2, then fM=+3.0. Therefore the function fM yields equal and opposite results when the $D_1$ and $D_2$ magnitudes are different by a given factor, in either direction, i.e., smoldering or flaming.

Elements 26-3 and 26-4 which implement a function of max(0.01, $D_n$) guarantee that the logarithm of the ratio exists. The IF/THEN/ELSE logic of element 26-2 defines the default value of fM, and therefore the default sensitivity for small input signal magnitudes.

Referring again to FIG. 2, we may define the respective fire scenario for cases where:

| | | |
|---|---|---|
| fM = 3.0 | as | FLAMING |
| −3.0 ≦ fM ≦ +3.0 | as | MEDIUM |
| +3.0 < fM | as | SMOLDERING |

FIG. 5 illustrates implementation of curve 12b shown in FIG. 2. The circuitry 26-1 assigns the desired values to the coefficients C1, C2 based upon the appropriate fire type. For example:

| | |
|---|---|
| If fM < −3.0 | then a FLAMING fire scenario exists. Assign 2.0 to all coefficients. |
| If −3.0 ≦ fM ≦ +3.0 | then a MEDIUM fire scenario exists. Assign 0.5 all coefficients. |
| If +3.0 < fM | then a SMOLDERING fire scenario exists. Assign 0.5 to all coefficients. |

The medium fire scenario coefficients received a 0.5 value to yield a 1.0 overall sensitivity. This assignment is based on sensor characteristics. Ion and optical sensors respond roughly equally for medium fire aerosols.

If the coefficient circuitry 26-1 assigned 1.0 to all coefficients, then the final stage of summing weighed senior values, in summer circuit 30, shown in FIG. 4, would output twice the signal as a single sensor. The 0.5 assignment compensates for this effect.

As an alternate, the circuitry 26-1 could assign 1.0 to the ion coefficient, and 0.0 to the photo coefficient for this medium case. Any number of alternate assignments to the coefficients yield similar compensatory results.

The output value on the line 30b, in FIG. 4 can undergo comparison to one or more predefined thresholds to generate a signal indicative of a fire. The above described process can generate any of the 27 possible sensitivity profiles within FIG. 2.

The above described process and apparatus can also generate any of the 243 possible combinations within FIG. 3, following assignment of reasonable fM indices for boundaries of the extreme flaming, flaming, smolder, extreme smolder, and dust scenarios. It will be understood that one of skill in the art could develop any or all of these combinations in light of the above description.

Figure 6:
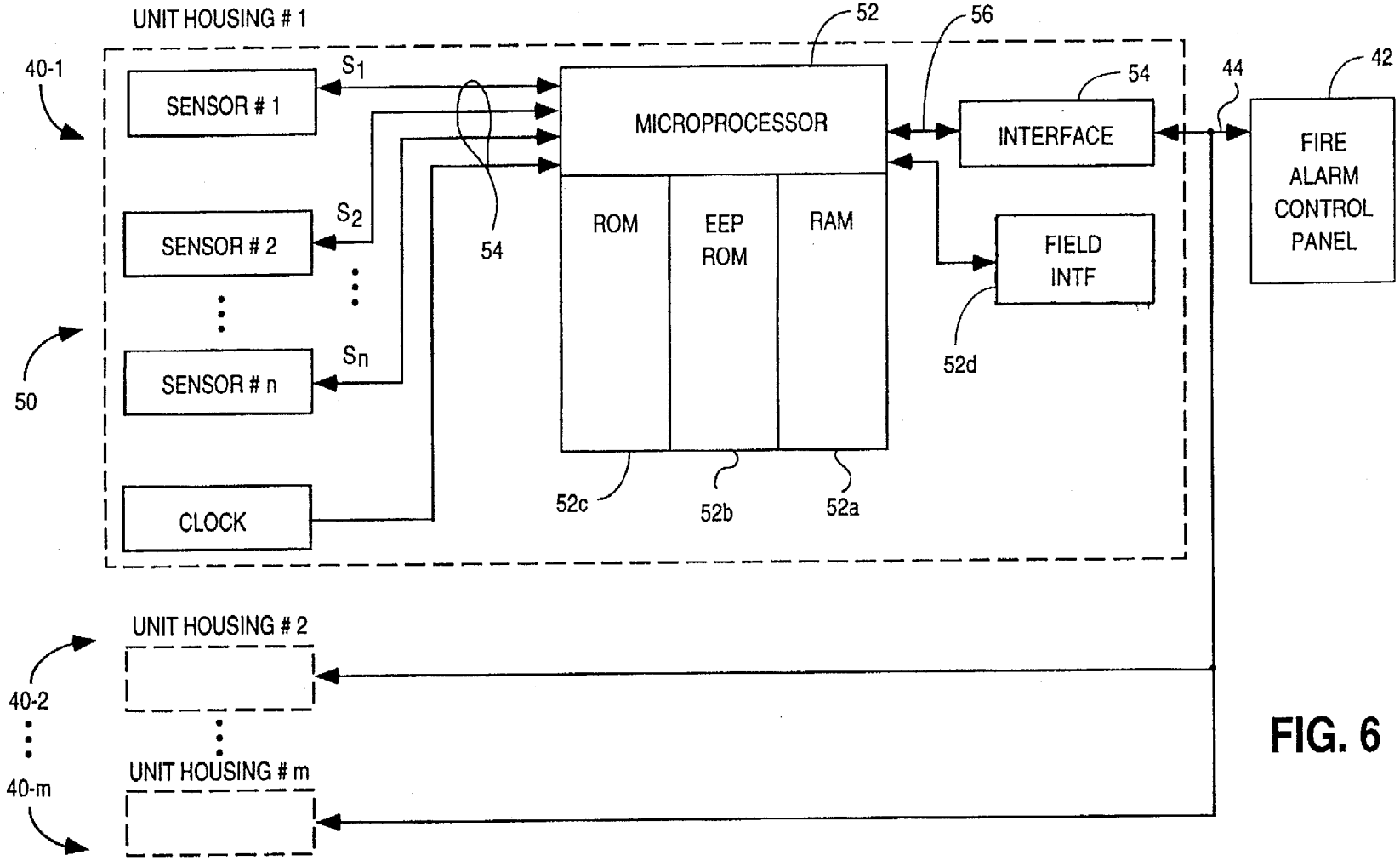
FIG. 6 is a block diagram of a microprocessor based detector in accordance with the present invention.

FIG. 6 is a microprocessor based hardware block diagram of a multiple sensor unit or detector 40-1. Other detectors 40-2 . . . 40-m, which could be the same as detector 40-1, are coupled along with detector. 40-1 to a fire alarm control apparatus or a panel 42.

The alarm apparatus 42 communicates with the detectors 40-1 . . . 40-m via a bidirectional communications link 44. The link 44 could be of a type, for example, as described in the above noted Tice et al. patent.

The exemplary detector 40-1 includes a plurality 50 of sensors 1-n. Each sensor provides information, via an electrical, optical, or combinational circuit, to a microprocessor (μP) 52.

In this embodiment, μP 52 performs optional signal conditioning, elements 24, coefficient generation, elements 26, multiplication, elements 28, and summation, element 30 shown in FIG. 4. The μP 52 preferably includes random access memory (RAM), 52a read only memory (ROM), 52b, and electrically erasable programmable read only memory (EEPROM) 52c.

μP A/D data inputs for sensor outputs $S_1$ . . . Sn on a plurality of lines 54, provide the necessary data conversion from analog to digital if the ambient condition sensors output analog data. Alternatively, the sensors 50 may incorporate a digital interface for direct input to μP digital input lines.

The operating programs, including fM equation, fire classifications, and coefficient assignments, are stored in ROM 52c. The desired or default sensitivity profile could be stored in ROM as well.

RAM 52a serves as calculation space, space for data structures, and as temporary storage for intermediate register values. EEPROM 52b stores any calibration/normalization constants, and any necessary filter or signal processing constants that have long term, dynamic properties. EEPROM 52b could also store the desired factory or field selected sensitivity profile.

The μP 52, after carrying out the summation illustrated in FIG. 4, yields a composite output value indicative of the aerosol quantity comparable to the output on the line 30b. The μP 52 may output analog or digital information, or both.

By means of a suitable interface 54, and communication lines 56, the composite output value can be communicated by link 44 to the control unit or panel 42. The control panel 42 may compare the composite signal value to a predetermined threshold for determination of fire status.

The composite output value shown in FIG. 4 on the line 30b could undergo comparison to a predetermined threshold internal to the local μP 52. Then the output from the local μP 52 may directly initate an audible or visible indication of fire.

Figure 7:
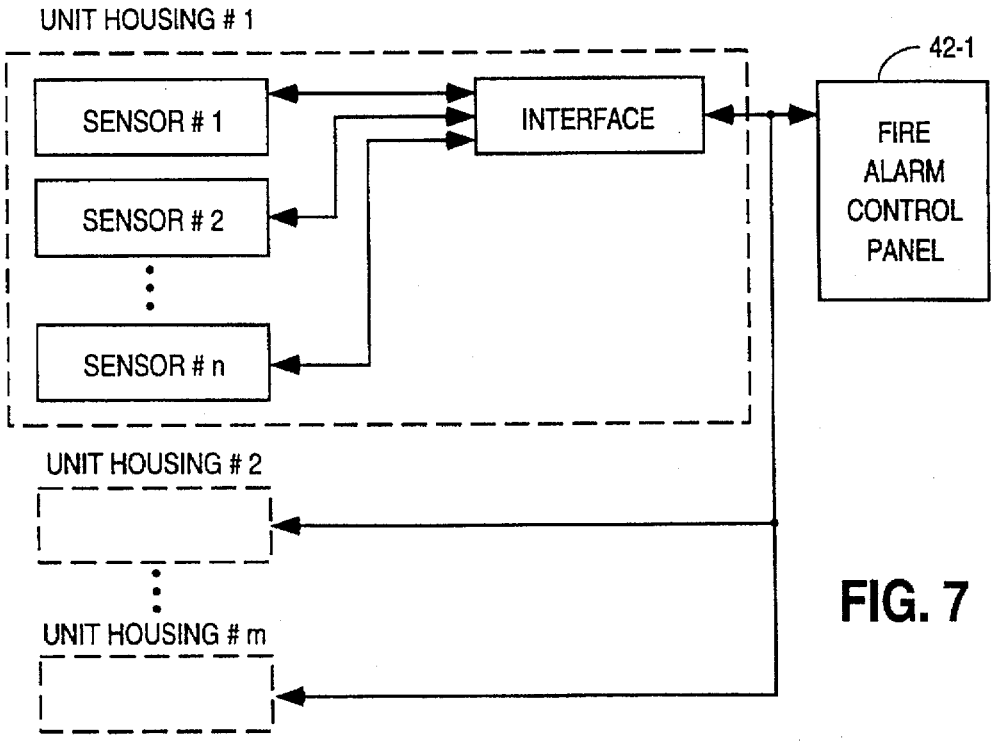
FIG. 7 is a block diagram of an alternate form of a detector in accordance with the present invention.
Figure 8:
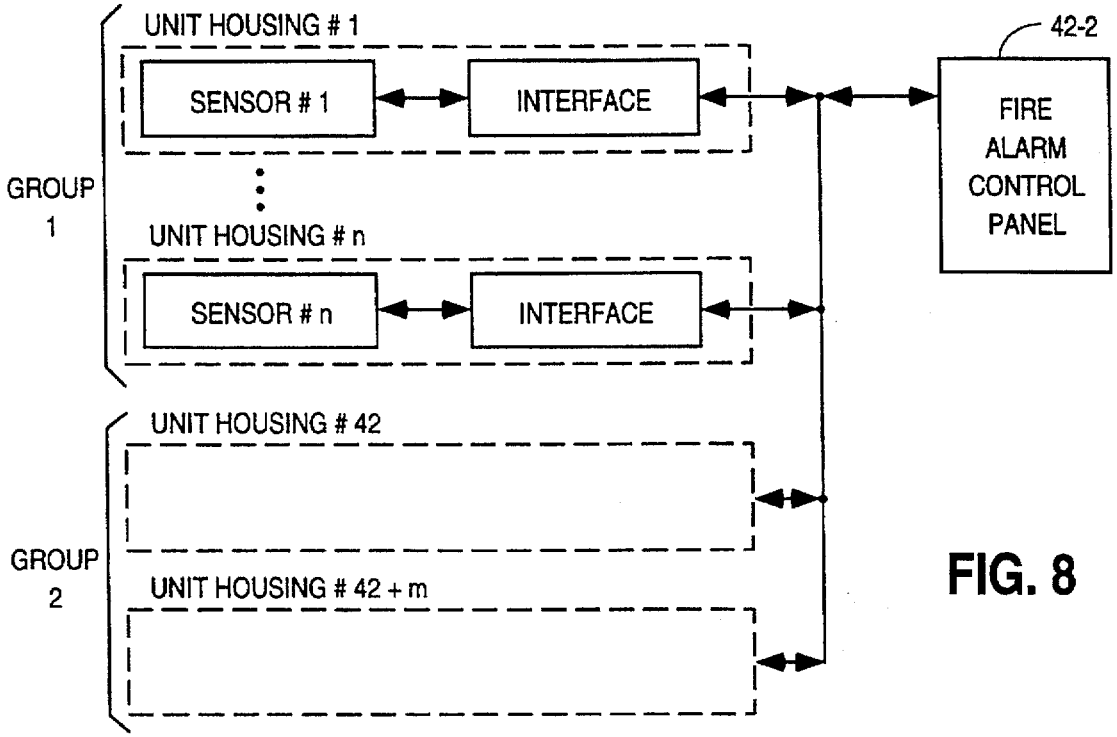
FIG. 8 is a block diagram of yet another detector in accordance with the present invention.

FIGS. 7 and 8 illustrate alternate configurations of the system hardware. Note that in the configurations of FIG. 7 and FIG. 8, the processing described above is carried out at control units or panels 42-1 and 42-2.

In another embodiment of the invention, an alternative methodology is used for implementation of the sensitivity profiles illustrated in FIGS. 2 and 3. More specifically, the ambient condition detector, such as the detector 20, utilizes fuzzy logic to generate coefficients C1 . . . Cn.

Figure 9:
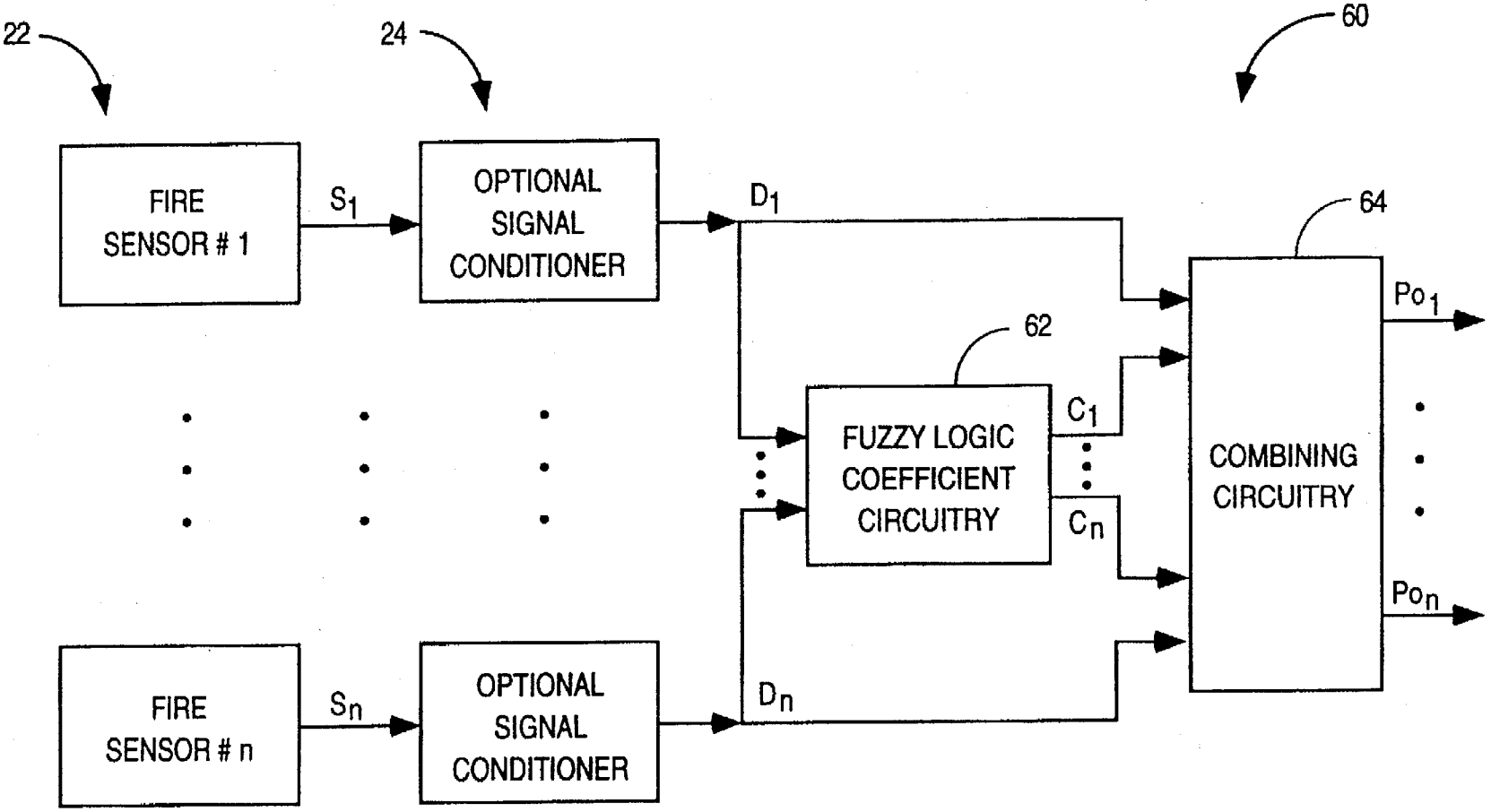
FIG. 9 is a block diagram of a multiple sensor detector based on fuzzy logic in accordance with the present invention.

FIG. 9 illustrates an embodiment of a detector 60 wherein the sensitivity profiles are implemented using fuzzy logic. In the detector 60, plural ambient condition sensors 22, such as an ionization smoke sensor and an optical smoke sensor each undergo optional signal conditioning.

The signal conditioning could include bandpass filtering from 4 μHz to 10 mHZ to equalize the speed of each transducer, and to eliminate offsets. The signal conditioning for each sensor or transducer could also normalize each sensor output, such that each conditioned output D1 . . . Dn yields a value of 1.0 (or any equal value) when stimulated by a smoldering wick smoke (or any chosen aerosol) concentration of optical density 1%/ft.

The actual numerical values for normalization and type of signal processing are readily determined through empirical test data, and through overall design objectives. This selection and determination are not limitations of the present invention.

The conditioned signals D1 . . . Dn are inputs to fuzzy logic coefficient generating circuitry 62. The circuitry 62, as described subsequently, generates a plurality of continuously variable coefficients C1 . . . Cn.

Each coefficient $C_i$ is combined with a respective conditioned signal value Di in combining circuitry 64 and arithmetically processed, to produce output(s). The outputs POi can, but need not be, combined to form a single composite output signal.

Figure 10:
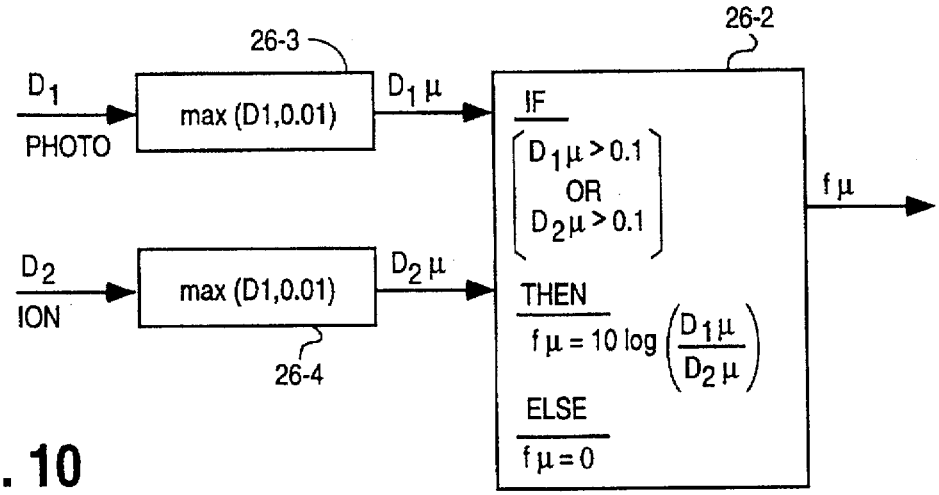
FIG. 10 is a block diagram of an apparatus for generating a fire mode index.

The coefficient generator 62 first determines the "fire mode index" fM as illustrated in FIG. 10 for two inputs:

fM=10 log $(D_1/D_2)$ where $D_1$=filtered and normalized photo signal $D_2$=filtered and normalized ion signal As previously discussed, the circuits 26-3, 26-4 implement a max (0.01, $D_n$) operation to guarantee that the logarithm of the ratio exists. The IF/THEN/ELSE logic element 26-2 defines the default fM, and therefore the default sensitivity for small signal magnitudes.

Figure 11:
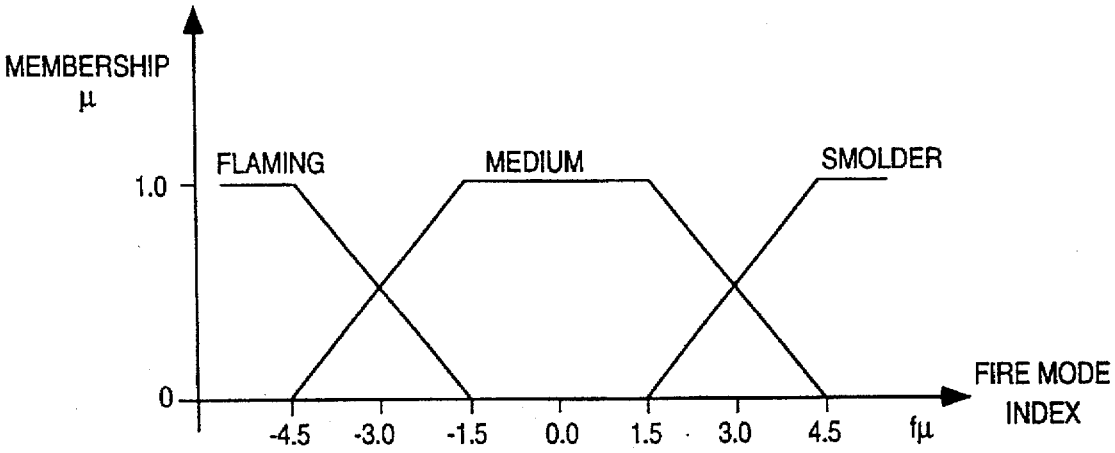
FIG. 11 is graph illustrating fire mode membership functions as a function of fire mode index.

FIG. 11 defines membership functions for classifications of fire modes. For example, an fM value of −3.0 has FLAMING membership of 0.5, MEDIUM membership of 0.5 and SMOLDER membership of 0.0. The default fM value of 0.0 has FLAMING membership of 0.0, MEDIUM membership of 1.0, and SMOLDER membership of 0.0.

Figure 12:
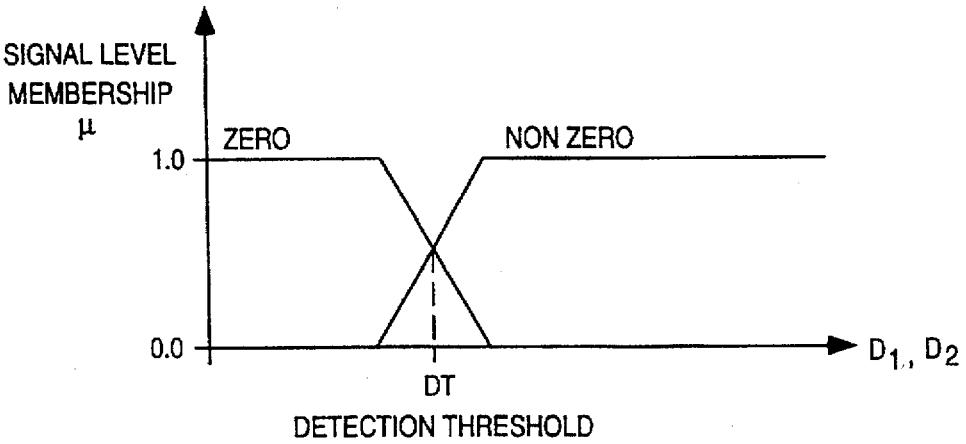
FIG. 12 is a graph illustrating input signal level membership functions.

FIG. 12 defines membership functions for classification of signal levels. Signals $D_1$ or $D_2$ appear as the ordinate, with membership functions for ZERO and NONZERO scaled by the abscissa.

Signals whose magnitude lies above a reliable detection threshold DT have a higher NONZERO membership value than do signals whose magnitude lies below DT. The specific ordinate values depend upon both environment and design.

In practice determination of these values follows from empirical knowledge of either or both of these governing factors as would be known to those of skill in the art. These 2 classifications could have dynamic properties over long time intervals, and so these characteristics may be stored in the EEPROM **52*b* of FIG. 6**.

Figure 13:
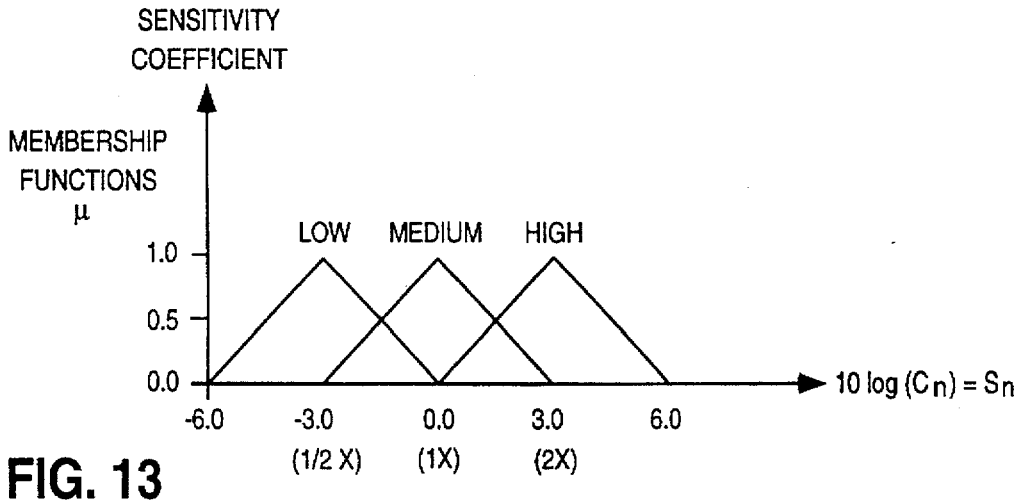
FIG. 13 is a graph illustrating sensitivity coefficient membership functions.

FIG. 13 illustrates the membership functions for classification of consequent sensitivities. The implementation of curve **12*b* illustrated in FIG. 2** requires a rule base, or a set of production modules. For example:

| | | |
|---|---|---|
| RULE 1 | IF | [fM is FLAMING] AND [PHOTO ($D_1$) is NONZERO] |
| | THEN | PHOTO SENSITIVITY ($S_1$) is MEDIUM<br>ION SENSITIVITY ($S_2$) is HIGH |
| | OR | |
| RULE 2 | IF | [FM is FLAMING] AND [PHOTO ($D_1$) is ZERO] |
| | THEN | PHOTO SENSITIVITY ($S_1$) is MEDIUM<br>ION SENSITIVITY ($S_2$) is MEDIUM |
| | OR | |
| RULE 3 | IF | fM is MEDIUM |
| | THEN | PHOTO SENSITIVITY ($S_1$) is LOW<br>ION SENSITIVITY ($S_2$) is LOW |
| RULE 4 | IF | fM is SMOLDER |
| | THEN | PHOTO SENSITIVITY ($S_1$) is LOW<br>ION SENSITIVITY ($S_2$) is LOW |

The term "antecedent" applies to the IF portion of a given rule. Similarly, the term "consequent" applies to the THEN portion of a given rule.

Each rule contains two consequences because, for a two sensor detector, the logic must ultimately create unique photo and ion coefficient outputs C1 and C2. All of the rules undergo the OR operator together. The rule based structure lends itself to intuitive linguistic interpretation in accordance with an on-going fire process.

Each rule antecedent contains some degree of truth, or membership, between 0.0 and 1.0. The membership functions associated with each statement indicate the degree of truth of each antecedent.

A rule with logical connectives within the antecedent requires a set operator to calculate a signal resultant membership value for that rule. Logical AND connectives specify the "minimum" or "intersection" set operator, while logical OR connectives specify the "maximum" or "union" set operator.

Implication such as THEN specifies the "minimum" or "intersection" operator in this example. Many types of connectives, or aggregates appear in the literature. For a description of the present invention and for disclosing the best mode only a few connectives are necessary as disclosed subsequently. More than one rule can have a membership value greater than 0.0.

For example, suppose photo ($D_1$) and ion ($D_2$) signal values of 0.2 and 0.4, respectively, as inputs appear at the fuzzy logic coefficient generation circuit 62 of FIG. 9. Then fM=−3.0. Assume that 0.2 represents a NONZERO signal level with membership 1.0, and a ZERO signal level with membership 0.0, shown in FIG. 12. Evaluation of the rules follows:

| | | | | |
|---|---|---|---|---|
| RULE 1 | IF | [fM is FLAMING] AND [PHOTO ($D_1$) is NONZERO] | | |
| | | $\mu = 0.5$ | $\mu = 1.0$ | $\mu_{RULE1} = 0.5$ |
| | OR | | | |
| RULE 2 | IF | [fM is FLAMING] AND [PHOTO ($D_1$) is ZERO] | | |
| | | $\mu = 0.5$ | $\mu = 0.0$ | $\mu_{RULE2} = 0.0$ |
| | OR | | | |
| RULE 3 | IF | fM is MEDIUM | | |
| | | $\mu = 0.5$ | | $\mu_{RULE3} = 0.5$ |
| | OR | | | |
| RULE 4 | IF | fM is SMOLDER | | |
| | | $\mu = 0.0$ | | $\mu_{RULE4} = 0.0$ |

Now the logic assigns these memberships to the consequent of each rule. So the (nonzero membership) consequent set for the rule base becomes:

| | | | |
|---|---|---|---|
| RULE 1 | THEN | PHOTO SENSITIVITY ($S_1$) is MEDIUM<br>ION SENSITIVITY ($S_2$) is HIGH | $\mu_{RULE1} = 0.5$ |
| OR | | | |
| RULE 3 | THEN | PHOTO SENSITIVITY ($S_1$) is LOW<br>ION SENSITIVITY ($S_2$) is LOW | $\mu_{RULE3} = 0.5$ |

To generate the final coefficient outputs, C1, C2, the consequent set undergoes defuzzification via the centroid method. A number of defuzzification methods exist in the literature. While the present embodiment uses the centroid method, other methods come within the spirit and scope of the present invention.

The photo consequent set specifies:

| | | |
|---|---|---|
| PHOTO SENSITIVITY ($S_1$) is MEDIUM | $\mu = 0.5$ | (From Rule 1) |
| OR | | |
| PHOTO SENSITIVITY ($S_1$) is LOW | $\mu = 0.5$ | (From Rule 3) |

Figure 14:
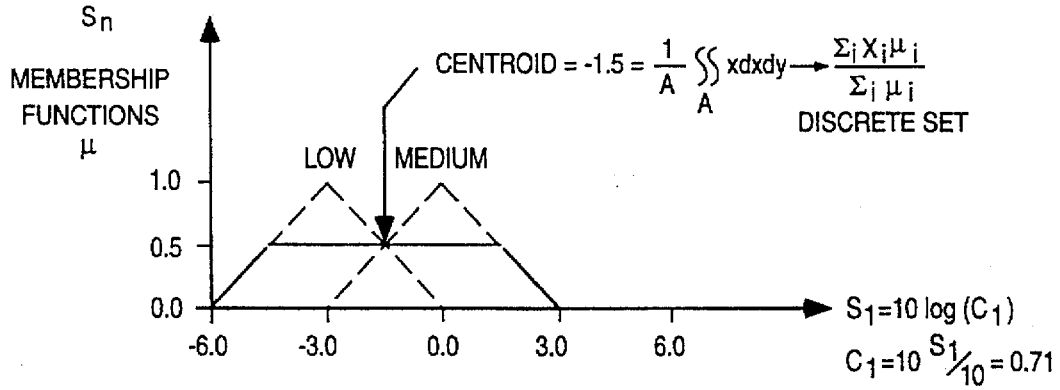
FIG. 14 is a graph illustrating centroid based generation of a sensitivity coefficient value for a photo-type sensor.
Figure 15:
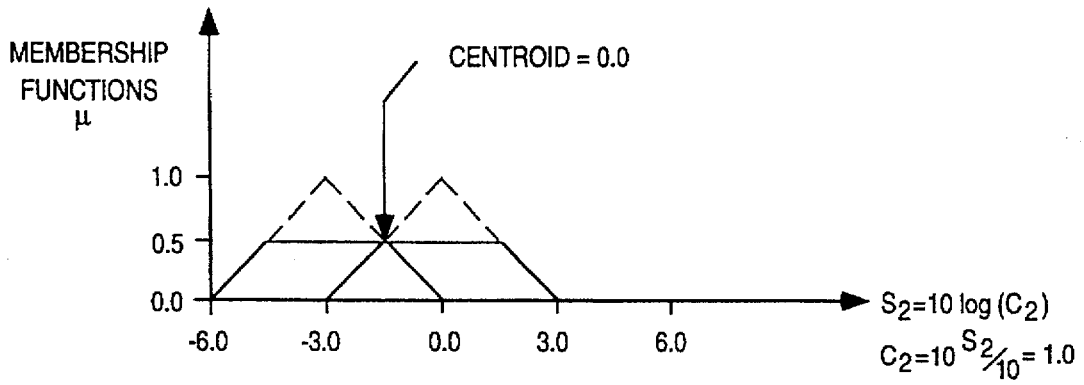
FIG. 15 is a graph illustrating centroid based generation of a sensitivity coefficient value for an ion-type sensor.

FIGS. 13–15 illustrate the membership functions for output sensitivity classification. The two THEN implications for the photo specify $\mu$=0.5 for both, so the MEDIUM and LOW functions appearing in FIG. 13 undergo the minimum operator with 0.5 FIG. 14 shows the result of this operation, along with a centroid determination of −1.5. Since the ordinate exists as a logarithmic scale, the conversion to a linear coefficient, $C_1=10^{-01.5/10}=0.71$. This completes the generation of the photo coefficient.

The ion consequent set specifies:

| | | |
|---|---|---|
| ION SENSITIVITY ($S_2$) is HIGH | $\mu = 0.5$ | (From Rule 1) |
| OR | | |
| ION SENSITIVITY ($S_2$) is LOW | $\mu = 0.5$ | (From Rule 3) |

The two THEN implications for the ion type sensor also specify $\mu$=0.5 for both, so the HIGH and LOW functions appearing in FIG. 13 undergo the minimum operator with 0.5. The resultant centroid of 0.0 yields a final coefficient of $C_2=10^{0.0/10}=1.0$. This completes generation of the ion coefficient.

The coefficient values of 0.71 for photo and 1.0 for ion make sense for the transition region between FLAMING and MEDIUM fire modes, and is consistent with curve 12b of FIG. 2. The choice of data more central to a specified fire mode yields coefficients more consistent with intuition. In fact, the fuzzy logic largely serves to smooth the transitions across the fire modes, whereas the earlier described embodiment tends to create rather abrupt transitions.

This example yielded centroid calculations from symmetric geometry shown in FIGS. 14 and 15. But general asymmetric geometry necessitates arithmetic evaluation. In the general case the centroid follows by:

CENTROID=$\{\Sigma_i\ x_i\ \mu_i\}/\{\Sigma_i\ \mu_i\}$ where $x_i$ represents the ordinate $\mu_i$ represents membership value associated with $x_i$ This form of the centroid operation allows the processing of discrete sets such as lookup tables inside microprocessor memory.

RULE 1 could have preferably specified THEN PHOTO-SENSITIVITY is LARGE, ION SENSITIVITY is LARGE. But the detector performance then changes only slightly due to the small contribution of photo sensor signal in flaming fires, anyway. The given consequents were chosen merely to illustrate independence of the coefficient outputs.

Figure 16:
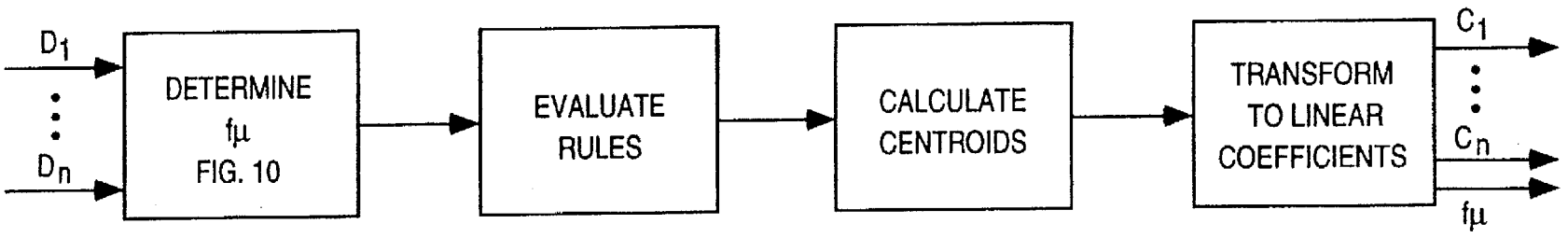
FIG. 16 is a flow diagram illustrating coefficient generation in accordance with FIG. 10.

FIG. 16, a generalization of FIG. 5, illustrates a flow diagram of a method, in accordance with the present invention, of determining the set of coefficients C1 . . . Cn from a set of processed inputs D1 . . . Dn. The method of FIG. 16 could be implemented using either hardwired logic, such as a programmable logic array, or in a programmed microprocessor or other integrated circuit combinations.

At this juncture note that the coefficient generator 62 could provide output information descriptive of the fire mode as well as n discrete coefficients.

The coefficients $C1–C_n$ shown in FIG. 9 now flow to the combining circuit 64. For the present example, the combination may consist of multiplication of $C_n$ with respective $D_n$, and subsequently executing $\Sigma_n C_n D_n$ along with any offset value. Now the processed output(s) can undergo comparison to a predefined threshold(s) to generate a signal indicative of a fire or the like. Outputs from circuitry 64, via an interface, such as interface 54 can be transmitted via communication link 44 to the system control unit or panel 42.

The above described method can generate any of the 27 possible sensitivity profiles within FIG. 2. The method can also generate any of the 243 possible combinations within FIG. 3, following assignment of reasonable fM indices for boundaries of the extreme flaming, flaming, smolder, extreme smolder, and dust scenarios. One of skill in the art could readily carry out this process in accordance with the above description.

FIG. 6 illustrates a system hardware block diagram which can be used to implement the above described fuzzy logic based determination of the coefficients Ci. The n sensors 50 each provide information, via an electrical, optical, or combinational circuit and lines 54 to a microprocessor (μP) 52.

The μP 52 performs optional signal conditioning, coefficient generation, and combination shown in FIG. 9. The μP 52 preferably contains random access memory (RAM), read only memory (ROM), and electrically erasable programmable ready only memory (EEPROM).

μP A/D data inputs for $S_n$ provide the necessary data conversion if the ambient condition sensors 50 output analog data. Alternatively, the sensors may incorporate a digital interface for direct input to digital input lines of the processor 50.

The operating program, including fM equation, fire classifications, coefficient assignments, and combining logic are stored in ROM memory 52c. The desired or default sensitivity profile could be stored in ROM as well. RAM memory 52a serves as calculation space, space for data structures, and as temporary storage for intermediate register values.

Representations of the membership functions of FIGS. 11–13 are stored in ROM memory 52c or EEPROM memory 52b. The advantage of EEPROM storage is that the function representations are field programmable via an optional interface 52d. Membership function processing, as in FIGS. 14, 15 can be carried out by microprocessor 52 using RAM memory 52a for temporary storage.

EEPROM memory 52b stores any calibration/normalization constants, and any necessary filter or signal processing constants that have long term, dynamic properties. EEPROM could also store the desired factory or field selected sensitivity profile.

The μP 52 combines each conditioned signal Dn with a corresponding coefficient Cn, corresponding to combining circuitry 64 of FIG. 9. The combined outputs (Dn Cn) can be summed by μP 52 to produce a processed output value indicative of the aerosol quantity and perhaps fire mode. The combined outputs (Dn Cn) can be output without summation.

The μP 52 may output analog or digital information, or both. By means of the interface, 54 the information can be transferred to the central control panel 42. The control panel 42 may compare the composite signal value(s) to one or more predetermined thresholds for determination of fire status.

The processed output value(s) shown in FIG. 9 could undergo comparison to a predetermined threshold internal to the local μP. Then the output from the local μP may directly initiate an audible or visible indication of fire or the like.

Figure 17:
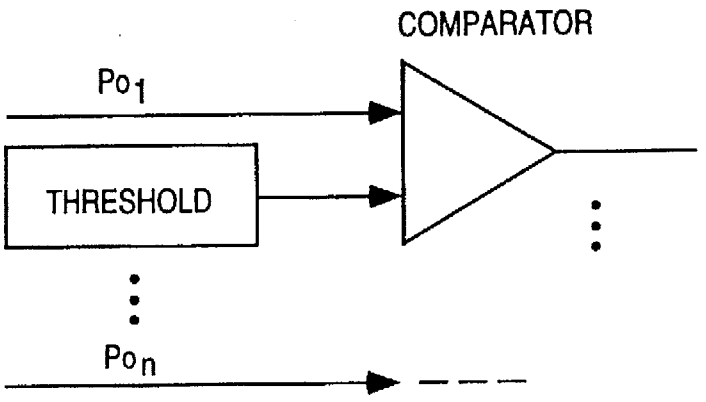
FIG. 17 shows one or more thresholds being compared to one or more detector outputs.

FIG. 17 illustrates one or more thresholds being compared to one or more detector outputs Poi. It will be understood that such comparisons could be carried out in the processor 52 or in the alarm control panel 42.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

I claim:

1. A variable sensitivity detector comprising:

at least first and second, different, ambient condition sensors for generating respective first and second outputs indicative of respective sensed ambient conditions;

coefficient circuitry, responsive to said outputs, for forming continuously variable first and second weighing coefficients for respective of said outputs;

circuitry for combining said weighing coefficients with respective of said outputs, thereby forming respective first and second weighted outputs; and circuitry for summing said weighted outputs thereby forming a processed output value.

2. A detector as in claim 1 wherein said coefficient circuitry includes at least first membership function circuitry associated with respective of said outputs.

3. A detector as in claim 2 wherein said coefficient circuitry includes second membership function circuitry.

4. A detector as in claim 2 wherein said coefficient circuitry includes circuitry for determining first and second centroid values, wherein each of said centroid values is associated with a respective one of said weighing coefficients.

5. A detector as in claim 1 wherein said first and second sensors include respective first and second fire detectors.

6. A detector as in claim 1 wherein said first and second sensors include at least one smoke sensor.

7. A detector as in claim 1 wherein at least one of said sensors includes a temperature sensor.

8. A detector as in claim 1 wherein said coefficient circuitry includes circuitry for forming a ratio of said first and said second sensor outputs.

9. A detector as in claim 8 wherein said coefficient circuitry includes circuitry for forming a logarithm of said ratio.

10. A fire detector with a sensitivity parameter which varies in accordance with fire type, the detector comprising:

a first type of fire sensor for generating a first fire output;

at least a second type of fire sensor for generating a second fire output;

circuitry, coupled to said sensors, for processing said outputs and for producing first and second, varying coefficients wherein said processing circuitry includes circuitry for storing at least one membership function indicative of fire type and circuitry for combining said fire outputs with respective ones of said coefficients thereby forming first and second processed outputs.

11. A detector as in claim 10 which includes a comparator for comparing at least one of said processed outputs to a threshold value.

12. A detector as in claim 10 wherein said processed outputs are combined to form at least one composite output.

13. A detector as in claim 12 which includes comparison circuitry and wherein said composite output is compared to at least one fire indicative threshold value.

14. A detector as in claim 10 wherein said sensors each include a smoke detector.

15. A detector as in claim 10 wherein said circuitry for processing includes circuitry for storing a second membership function.

16. A detector as in claim 10 wherein said processing circuitry includes circuitry for forming at least one ratio of said fire outputs.

17. A detector as in claim 10 wherein said processing circuity includes circuitry for storage of at least first and second membership functions.

18. A detector as in claim 10 wherein said processing circuitry includes a programmed digital processor.

19. A detector as in claim 18 wherein said programmed processor includes circuitry for storage of first and second membership functions.

20. A variable sensitivity detector comprising:

a plurality of ambient condition sensors for generating respective ambient condition outputs;

a storage unit for storing a set of predetermined production rules;

circuitry for processing said outputs, in response to said production rules, thereby producing a plurality of continuously variable coefficients; and circuitry for combining respective ones of said outputs with respective ones of said coefficients thereby producing a plurality of adjusted outputs.

21. A detector as in claim 20 which includes:

circuitry for combining said adjusted outputs.

22. A detector as in claim 21 wherein said circuitry for combining said output includes a summer.

23. A detector as in claim 22 wherein said summer includes digital addition circuitry.

24. A detector as in claim 20 wherein said combining circuitry includes a multiplier.

25. A method of detecting the presence of different ambient conditions comprising:

storing a set of predetermined rules pertaining to at least first and second different ambient conditions;

sensing at least first and second different ambient conditions and generating respective first and second indicia indicative thereof;

implementing the prestored rules to process the indicia thereby providing first and second coefficients wherein each of the coefficients is indicative of the level of one of the ambient conditions relative to the other.

26. A method as in claim 25 wherein producing the coefficients includes predetermining a centroid value wherein a determined value is indicative of a respective output.

27. A method as in claim 25 wherein the ambient conditions are combined with the respective indicia thereby producing first and second combined outputs wherein the combined outputs are each indicative of the level of the respective ambient condition.

28. A method as in claim 27 which includes summing the combined outputs.

29. A method as in claim 28 which includes comparing the summed outputs to a threshold.

* * * * *